US007008912B1

(12) United States Patent
Rettenmaier et al.

(10) Patent No.: US 7,008,912 B1
(45) Date of Patent: Mar. 7, 2006

(54) PRESSED PIECE WHICH DISINTEGRATES IN LIQUIDS

(75) Inventors: Josef Otto Rettenmaier, Rosenberg (DE); Hans-Friedrich Kruse, Korschenbroich (DE); Martin Holl, Abtsgmuend (DE); Harald Schlosser, Ellwangen (DE); Armin Ungerer, Crailshelm (DE)

(73) Assignee: Henkel KGaA, Dusseldorf-Holthausen (DE)

( * ) Notice: Subject to any disclaimer, the term of this patent is extended or adjusted under 35 U.S.C. 154(b) by 184 days.

(21) Appl. No.: 09/380,739

(22) PCT Filed: Feb. 28, 1998

(86) PCT No.: PCT/DE98/00589

§ 371 (c)(1),
(2), (4) Date: Dec. 15, 1999

(87) PCT Pub. No.: WO98/40462

PCT Pub. Date: Sep. 17, 1998

(30) Foreign Application Priority Data

Mar. 11, 1997 (DE) ..... 197 09 991

(51) Int. Cl.
*C11D 17/00* (2006.01)
*C11D 11/00* (2006.01)
*C11D 7/44* (2006.01)
*C11D 3/382* (2006.01)
*C11D 3/22* (2006.01)

(52) U.S. Cl. ..... 510/298; 510/446; 510/441; 510/462; 510/473

(58) Field of Classification Search ..... 501/298, 501/446, 441, 462, 473
See application file for complete search history.

(56) References Cited

U.S. PATENT DOCUMENTS

| | | | | |
|---|---|---|---|---|
| 2,560,097 | A | 7/1951 | Emerson et al. | 252/89 |
| 3,338,836 | A | 8/1967 | Krusius et al. | |
| 3,360,469 | A | 12/1967 | Fuchs et al. | |
| 3,370,015 | A | 2/1968 | van Kampen et al. | |
| 3,417,024 | A | 12/1968 | Goldwasser | |
| 3,424,842 | A | 1/1969 | Nürnberg | |
| 3,490,742 | A | 1/1970 | Nichols et al. | 424/464 |
| 3,622,677 | A | 11/1971 | Short et al. | |
| 3,951,821 | A | 4/1976 | Davidson | 252/1 |
| 3,953,350 | A | 4/1976 | Fujino et al. | |
| 4,013,581 | A | 3/1977 | Huber | 252/186 |
| 4,072,535 | A | 2/1978 | Short et al. | |
| 4,219,435 | A | 8/1980 | Biard et al. | |
| 4,230,590 | A * | 10/1980 | Wixon | 510/308 |
| 4,269,859 | A | 5/1981 | Morse | 424/362 |
| 4,361,545 | A | 11/1982 | Powell et al. | |
| 4,369,308 | A | 1/1983 | Trubiano | |
| 4,551,177 | A | 11/1985 | Trubiano et al. | |
| 4,585,642 | A | 4/1986 | Rieck | |
| 4,622,161 | A | 11/1986 | Cornelissens et al. | |
| 4,642,197 | A | 2/1987 | Kruse et al. | |
| 4,695,397 | A | 9/1987 | Sommer et al. | |
| 4,751,015 | A | 6/1988 | Humphreys et al. | |
| 4,818,426 | A | 4/1989 | Humphreys et al. | |
| 4,950,310 | A | 8/1990 | Rieck et al. | |
| 5,000,947 | A * | 3/1991 | Nichols | 424/69 |
| 5,006,345 | A | 4/1991 | Lang | 424/467 |
| 5,043,091 | A | 8/1991 | Joshi et al. | |
| 5,360,567 | A | 11/1994 | Fry et al. | |
| 5,382,377 | A | 1/1995 | Raehse et al. | 252/174 |
| 5,407,594 | A | 4/1995 | Fry et al. | |
| 5,411,673 | A | 5/1995 | Agar et al. | 252/186.27 |
| 5,468,286 | A | 11/1995 | Wai-Chiu et al. | |
| 5,656,584 | A * | 8/1997 | Angell et al. | 510/441 |
| 5,681,475 | A * | 10/1997 | Lamensdorf et al. | 210/666 |
| 5,783,545 | A | 7/1998 | Paatz et al. | 510/305 |
| 5,866,531 | A | 2/1999 | Assmann et al. | |
| 5,900,399 | A | 5/1999 | Seiter et al. | |
| 6,051,545 | A | 4/2000 | Boskamp | |
| 6,221,832 | B1 * | 4/2001 | Casteel et al. | 510/446 |
| 6,232,285 | B1 * | 5/2001 | Casteel et al. | 510/446 |
| 6,288,016 | B1 * | 9/2001 | Ramanan et al. | 510/357 |
| 6,294,509 | B1 | 9/2001 | Meiwa et al. | 510/130 |
| 6,303,560 | B1 * | 10/2001 | Hartan et al. | 510/446 |
| 6,358,910 | B1 * | 3/2002 | Boskamp et al. | 510/446 |
| 6,372,707 | B1 * | 4/2002 | Boskamp et al. | 510/440 |

FOREIGN PATENT DOCUMENTS

| | | |
|---|---|---|
| DE | 938 566 | 2/1956 |
| DE | 1 228 029 | 5/1964 |
| DE | 2 321 693 | 4/1973 |
| DE | 2 362 595 | 12/1973 |
| DE | 2 263 939 | 7/1974 |
| DE | 23 21 693 | 11/1974 |
| DE | 23 54 096 | 5/1975 |
| DE | 23 62 595 | 6/1975 |
| DE | 34 17 649 | 11/1985 |
| DE | 34 17 820 | 11/1985 |

(Continued)

OTHER PUBLICATIONS

Derwent Reference No. 93-340000/43 (Dec. 12, 1990), Abstract of Japanese Patent No. JP 5-247495.

(Continued)

*Primary Examiner*—Lorna M. Douyon
(74) *Attorney, Agent, or Firm*—Connolly Bove Lodge & Hutz LLP

(57) ABSTRACT

The invention relates to a pressed piece consisting of ingredients in powder and/or granular form, which contains particles made of a material containing cellulose, particularly in compacted form, which act as an explosive agent. TMP and CTMP can be used as the cellulose-containing material.

23 Claims, 1 Drawing Sheet

FOREIGN PATENT DOCUMENTS

| | | |
|---|---|---|
| DE | 34 22 055 | 12/1985 |
| DE | 37 42 043 | 6/1989 |
| DE | 41 21 127 | 1/1993 |
| DE | 41 33 862 | 4/1993 |
| DE | 2 263 940 | 7/1994 |
| DE | 195 00 936 | 7/1996 |
| DE | 195 00 936 A1 | 7/1996 |
| DE | 197 09 991 | 9/1998 |
| EP | 0 075 818 | 4/1983 |
| EP | 0 096 680 | 12/1983 |
| EP | 0 352 135 | 7/1989 |
| EP | 0 367 339 | 10/1989 |
| EP | 0 266 863 | 3/1990 |
| EP | 0 390 251 | 3/1990 |
| EP | 0 425 277 | 10/1990 |
| EP | 0 458 397 | 5/1991 |
| EP | 0 458 398 | 5/1991 |
| EP | 0 466 485 | 7/1991 |
| EP | 0 466 484 | 1/1992 |
| EP | 0 522 766 | 6/1992 |
| EP | 0 523 099 | 1/1993 |
| EP | 0 549 272 | 6/1993 |
| EP | 0 711 827 | 5/1996 |
| EP | 0 711 828 | 5/1996 |
| EP | 0 716 144 | 6/1996 |
| EP | 0 737 738 | 10/1996 |
| EP | 0 340 013 | 2/1997 |
| GB | 911204 | 11/1962 |
| GB | 1423536 | 2/1976 |
| GB | 2 242 130 | 9/1991 |
| JP | 60-15500 | 1/1985 |
| JP | 62-30198 | 2/1987 |
| JP | 62-197497 | 9/1987 |
| JP | 2-311600 | 12/1990 |
| JP | 4-164999 | 6/1992 |
| JP | 5-247495 | 9/1993 |
| JP | 7-286199 | 10/1995 |
| WO | WO 91/15567 | 10/1991 |
| WO | WO 95/06109 | 3/1995 |
| WO | WO 96/06156 | 2/1996 |
| WO | WO 96/28530 | 9/1996 |
| WO | WO 98/40462 | 9/1998 |
| WO | WO 98/55582 | 12/1998 |
| WO | WO 98/55583 | 12/1998 |
| WO | WO 98/55590 | 12/1998 |

OTHER PUBLICATIONS

Novak, J., et al., Enzyme Tablets for Improving Low-Temperature Laundering, Chemical Abstracts & Indexes, vol. 122, No. 2 (Jan. 1995) [XP 000666852].

Herausgeber, "Rompp Chemie Lexikon" Georg Thieme Verlag Stuttgart. Neew York pp. 3207-3212 (1995) 9th edition.

Herausgegeben, "Rompp Chemie Lexikon" Thieme pp. 4439-4440 (1995) 9th edition.

Herausgeber, "Rompp Chemie Lexikon" Thieme pp. 4990-4993 and 4295 (1995) 9 edition.

Mitteilungen der Deutschen Pharmazeutischen Gesellschaft der DDR [Communications from the German pharmaceutical society and from the pharmaceutical society of East Germany], vol. 38, pp. 165-181 (1968).

Rehocel® 4500 mal kleiner—der Hilfsstoff der viele Probleme löst (1968).

Ullmanns Enzyklopädie der Technischen Chemie [Ullmann's Encyclopedia of Technical Chemistry], vol. 9, p. 187 (4th ed. 1975).

Degussa company publication No. 38 "Tableting with ELCEMA" (Jan. 1984).

Lehrbuch der pharmazeutischen Technologie, 6, pp. 182-184 (1987) (English Translation).

Degussa company publication No. 67 "ELCEMA auxiliaries for direct tableting" (Dec. 1989).

Römpp Chemie Lexikon, vol. 6, p. 4440 (9th ed. 1992) (English Translation).

SÖFW-Journal, 122, pp. 1016-1021 (1996).

"Untersuchungen über Kompaktierung und Trockengranulierung," *Pharmaceutica Acta Helvetiae*, vol. 41, (Oct. 7, 1965).

Von E. Nurnberg, "Experimentelle Prüfungen von direct verpreβten Tablettengrundlagen", *Pharm. Ind.*, vol. 34, No. 3, pp. 193-206 (1972).

Von Engelbert Graf, "Cellulose, ein wertvoller Hilfs—und Rohstoff für die Arzneibereitung" *Deütsche Apotheker Zeitung*, vol. 118, No. 43, pp. 1625-1629 (Oct. 26, 1978).

Size Conversion Table (U.S. Mesh, Tyler Mesh, Inches, and Microns), no date available.

*Ullmanns Encyklopädie der technischen Chemie* [Ullmann's Encyclopedia of Technichal Chemistry], vol. 22, pp. 467-468 (4th ed. 1975).

Versuchsberitch über das Nacharbeiten von US-Patent Nr. 4,269,859 zur Bestimmung des Schüttgewichtes des verdichteten Cellulosegranulats, no date available.

* cited by examiner

PRESSED PIECE WHICH DISINTEGRATES IN LIQUIDS

The invention relates to a laundry detergent compact comprising a pulverulent and/or granular laundry detergent composition and an incorporated disintegrant comprising finely-divided, cellulose material, which is intended for rapid dissolution/dispersion with release of the laundry detergent composition following introduction into liquid.

The provision of dishwasher detergents in the form of compacts of this kind is already conventional. To facilitate handling and dosing, these compacts are offered in the form of what are known as "tabs" (from "tablets"), having the size and form of chocolate candies and containing an amount of detergent sufficient for one wash in the dishwasher. Although the dishwasher detergent compacts act like small stones as a result of the compaction, they dissolve, without actually disintegrating, in hot flowing water, progressively from the outside to the inside, rapidly and completely, as a consequence of the dissolution of the ingredients in the water. This property of the dishwasher detergent compacts can be traced back to the composition of dishwasher detergents, which include no strongly differing components and, in particular, no insoluble components.

The problem of simple and reliable dosing arises not only with dishwasher detergents but also with other substances, and not only in the household but also in the industrial sector. Examples are, for example, dye compositions for the dyeing of textiles, other chemicals from which solutions of specific concentrations are to be prepared, and, in particular, detergents for textile laundry, preferably in the domestic and industrial sectors, for example, clothes, bed and table linen, towels and the like. Detergents for these purposes have to date been marketed only in flowable or free-flowing form, i.e., as liquids and, predominantly, as powders or granules. This form of compounding requires the user to carry out portioning; in other words, it is necessary to place a specified amount of liquid or a specified amount of powder or granules into the washing machine. Serious errors are possible in this context if the user uses too much or too little detergent, whether mistakenly or intentionally. Furthermore, cases of soiling as a result of spills during the metering of the laundry detergent occur frequently.

The technique of providing compacts each containing a relatively large amount—for example, an amount sufficient for one wash—of the ingredients would also be of great significance for laundry detergents, since it would then be possible to limit metering to a counting procedure, without any need for weighing or volumetric operations. The laundry detergents, however, differ from the dishwasher detergents in that they are required to disperse much more rapidly in the washing liquid and are not intended to release their ingredients gradually. In addition, the laundry detergents include components which do not dissolve in water. As a consequence of the differences in the structure of the ingredients, portioning of laundry detergents in a manner comparable to that to date for the dishwasher detergent tabs has come up against difficulties, since the balance between abrasion resistance and fracture strength of the compacts during transport and storage, on the one hand, and sufficiently rapid disintegration of the compacts in the wash liquid, on the other hand, has been difficult to find and maintain.

Previous attempts to create practicable laundry detergent compacts are described in EP 466 484 A2, U.S. Pat. No. 5,382,377 and Derwent Ref.: 93-340 000/43. In the case of this prior art, on which the precharacterizing clause is based, attempts are made to bring about sufficiently rapid disintegration of the compacts in the wash liquid by means of an admixed and cocompacted disintegrant, for which cellulose is used in the three examples. The nature of the cellulose is described in more detail only in U.S. Pat. No. 5,382,377: there it is specified as microcrystalline cellulose, which indeed is known as a tablet disintegrant from the pharmaceutical sector as well.

It has been found, however, that the addition of pulverulent or finely particulate cellulose as a disintegrant to laundry detergent compacts is inadequate in its effect and is unable to ensure that the compacts disintegrate with sufficient rapidity in the wash liquid.

The object on which the invention is based is to design a laundry detergent compact of the generic type in such a way that following introduction into the liquid it rapidly disintegrates and releases the laundry detergent composition so that it can be dispersed in the liquid.

This object is achieved by means of the invention of a laundry detergent compact comprising a pulverulent and/or granular laundry detergent composition and an incorporated disintegrant comprising finely-divided, cellulose material, which is intended for rapid dissolution/dispersion with release of the laundry detergent composition following introduction into liquid, wherein the cellulose material is compacted prior to its admixture to the laundry detergent composition and is present in the compact in the form of compacted granules having a density of from 0.5 to 1.5 $g/cm^3$.

The laundry detergent compact is configured such that one compact or a number of compacts comprise(s) the amount of laundry detergent composition required for one load. The portioning takes place through the addition of one or more of these compacts, i.e., simply, by counting, rather than as hitherto by measuring out a specified quantity of a liquid or free-flowing composition. The laundry detergent compact must be of such a nature that it withstands handling on transport, storage and metering without instances of fragmentation and without substantial abrasion and yet breaks up with sufficient rapidity in water. For this purpose, the disintegrant is provided in the form of the compacted and granulated, finely particulate cellulose material which in the case of a medical tablet ensures that, on contact with the liquid, especially water, as a result of an increase in volume of the finely particulate particles within the mixture of the ingredients and the disintegrant, cracks occur in the laundry detergent compact through which the water penetrates rapidly into the interior of the laundry detergent compact and induces its disintegration.

The particular configuration of the disintegrant present in the laundry detergent compact is therefore of particular significance.

A very important aspect of the invention consists, to this extent, in that the finely particulate cellulose material is compacted prior to its admixture to the pulverulent laundry detergent.

The expression "compacting" in this case is intended to denote the exertion of a pressure on the cellulose material which compresses the volume of the cellulose material without destroying the fibers. In the case of compacting, therefore, the particles should have been deformed, in contrast to aggregation, where there is only accumulation of the particles without any substantial change in their form. Compacting in this sense is to be carried out prior to the admixture of the disintegrant so produced to the ingredients. When the laundry detergent compact comes into contact with water or the other liquid, the cellulose material springs back from its compacted state into a state with an open, relaxed volume. The question of whether this process is based on capillary or other forces can be disregarded. In any case, the enlargement in volume is substantially greater in degree than that which comes about in the case of simple swelling of the cellulose material.

Just as important is the provision of the cellulose material in granule form.

During or after compacting, therefore, granules are produced from the very finely divided—for example ground—starting material, said granules constituting relatively large aggregates of a large number of initial particles. These relatively large aggregates, i.e., the granules, are admixed to the ingredients and the mixture is compacted to form the laundry detergent compacts.

The purpose of these measures is to cause the individual ultrafine initial particles of the cellulose material to undergo, in contact with the liquid, the same relative increase in volume as a relatively large aggregate but with the absolute increase in volume of an ultrafine initial particle being too low to bring about local expansion enough to cause cracking in the material of the laundry detergent compact. The individual amounts add up in the granules to result in a macroscopic local expansion with a sufficient exploding effect.

In the case of the laundry detergents it is therefore possible to produce ready-to-use compacts which disintegrate in water within the periods of time under consideration.

An important dimension is the density of the compacted cellulose material, since it represents a measure of the appropriate compression of the material at which the right compromise is present between the strength adequate for handleability of the laundry detergent compact and its sufficient propensity to disintegrate.

In order to achieve the required rapid breakup with laundry detergents that have undergone necessary pressing to form a compact of sufficient strength, the need was not only for a particularly effective disintegrant but also for one which has as little impact as possible both chemically during the washing operation and also subsequently, after the wash, on the laundry. Both requirements are ensured by the use of the cellulose material, especially in compact form, as disintegrant. The cellulose material is virtually inert in washing solutions and virtually absent from the laundry.

The liquid is water in the majority of cases, although the invention is not restricted thereto. Instead, it can also be used with other liquids, for example, alcohol or the like.

The "cellulose materials" to be used as disintegrants in accordance with the invention should be those in which the cellulose is still present at least predominantly in chemically unaltered form.

In another field, namely that of pharmaceuticals, the concept of adding a cellulose, employed as a disintegrant for pharmaceutical tablets, by compacting and subsequent granulation into relatively large aggregates, is known per se by virtue of U.S. Pat. No. 4,269,859.

From U.S. Pat. No. 3,951,821 it can be inferred that tubular particles of cellulose material are incorporated into the tablets in order to promote the rapid disintegration of a tablet on contact with a liquid. The increase in the disintegration rate on contact with a liquid is based on the capillary effect, i.e., the liquid is conveyed rapidly into the interior of the tablet, thereby initiating the disintegration thereof.

A particle size of the staring material, which is in the form of relatively large granules following compaction, of 40–60 $\mu$m has proven judicious for laundry detergents. Such fine cellulose starting materials can be produced at a comminution expense which is still acceptable, and are virtually absent from the laundry.

The compacted particles of the cellulose material, i.e., the granules, can have a particle size of from 0.2 to 6.0 mm, in particular from 0.3 to 1.5 mm, the most judicious particle size depending inter alia on the size of the laundry detergent compact and, indirectly, on the nature of the ingredients of the detergent compact, insofar as, for example, different laundry detergents have different compositions with different pressing and disintegration properties.

The weight fraction of the compacted cellulose material in the finished detergent compact can be from 3 to 6 percent.

It is also advisable for the detergent compact to comprise, additionally, a fraction of finely divided noncompacted cellulose material.

This fraction, although it does not act as a disintegrant, may, however, develop a kind of wicking action in the pressed mass and may be useful for the more rapid penetrative progress of the water into the interior of the detergent compact.

The weight fraction of the uncompacted cellulose material in the finished detergent compact can be from 1 to 3 percent.

The compacted cellulose material present in the detergent compact can have a coating comprising a swelling agent and/or thickener.

Substances of this kind are known per se as tablet disintegrants in the pharmaceutical field (see "Römpp-Chemie-Lexikon" 9th edition (1995), page 4440, entry "Tablettensprengmittel" [Tablet disintegrants]).

Furthermore, it may be advisable for the cellulose material present in the detergent compact to have a coating comprising a surfactant, which can make up a weight fraction of from 0.5 to 5.0 percent of the finished detergent compact and which is present in the detergent compact in addition to the surfactant already present in the pulverulent laundry detergent. The surfactant is intended to promote the distribution of the liquid along the surface of the particles of the cellulose material.

The dispersion properties of the cellulose material can be increased if it is at least partly fibrillated, i.e., is comminuted down to the level of bundles each comprising a few cellulose fibers lying parallel to one another.

In order to achieve sufficient dispersibility, i.e., instant disintegration of the detergent compact following introduction into the liquid, it is advisable to press it from a mixture of the pulverulent or granular ingredients with the finely divided cellulose material in dry or earth-moist form.

The detergent compacts should therefore cohere only through the pressing which has taken place, and not by way of liquid components which subsequently harden and which would retard the disintegration of the detergent compact in the liquid or in the water.

In the course of the development work, two kinds of cellulose material were found particularly suitable, namely TMP (=thermo-mechanical pulp) and CTMP (=chemo-thermo-mechanical pulp).

These are two kinds of so-called mechanical woodpulp. In the case of the TMP process, wood chips are defibered under vapor pressure at about 130° C. in pressure refiners to form TMP. When chemicals are used in the initial steaming of the wood chips, the result is CTMP (see "Römpp-Chemie-Lexikon" 9th edition (1995), page 3207, entry "Papier" [Paper]).

In the case of the mechanical woodpulps TMP and CTMP, although a certain leaching of the material has taken place, the lignins, resins and other wood constituents have not been removed completely, in particular not as completely as in the case of cellulose production. These mechanical woodpulps therefore constitute cellulose materials which have retained a residuum of the woody character.

The two abovementioned materials have been found particularly effective as disintegrants for the compact in question, especially in the compacted state. Neither pure wood products such as wood flour or wood fibers, nor pure cellulose, are comparable in their disintegration behavior. In the case of the "moderately treated" products TMP and CTMP there exists a distinct maximum of effect.

The relevant dimensions of the laundry detergent compact are characterized by a larger dimension of from about 1 to 10 cm, preferably from 2 to 4 cm.

The drawing shows an exemplary embodiment of the invention in diagrammatic form.

Figure 1:
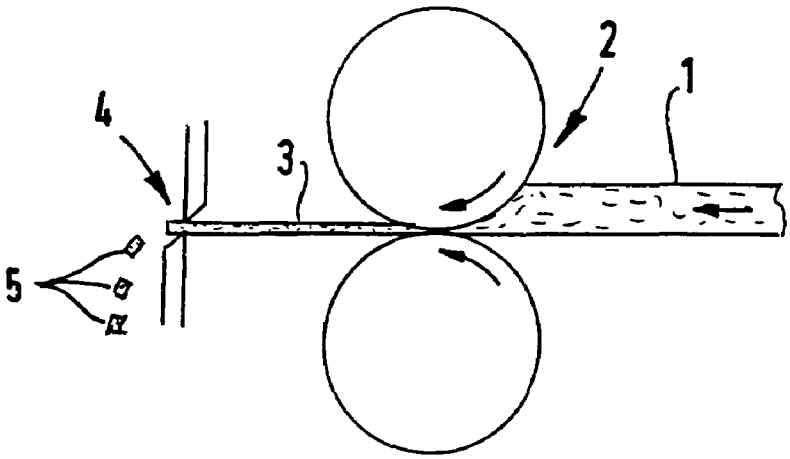
FIG. 1 shows one possible type of compacting of cellulose material.

In accordance with FIG. 1, a bed 1 of cellulose material, TMP in the exemplary embodiment, is passed to a pair 2 of press rolls in which compacting takes place with compression of the volume of the individual particles and joining thereof to form a kind of coherent, densified web 3. 4 symbolizes the comminution of the web 3 to granules 5.

Figure 2:
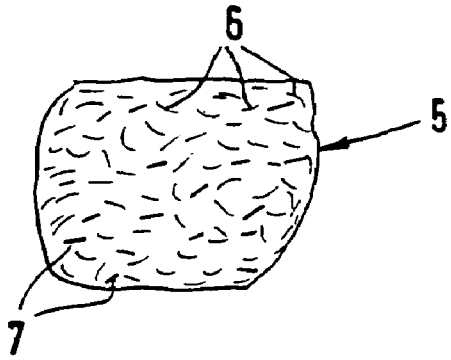
FIG. 2 shows a compacted granule.

A single granule 5 is shown in FIG. 2. It contains a relatively large number of ultrafine TMP particles 6 whose particle size is about 50 $\mu$m, i.e., the TMP material has a particle size distribution whose maximum lies at about 50 $\mu$m. The individual ultrafine TMP particles 6 hold together by virtue of the pressing action they have experienced between the pair 2 of press rolls. At the same time, the individual particles 6 have been compressed in the nip relative to their original form, i.e., they have undergone compaction.

The granules 5 in turn have a particle size distribution with a maximum at about 2 mm, i.e., the size of the granules 5 is about 2 orders of magnitude above the size of the ultrafine TMP particles they contain.

In accordance with FIG. 2, uncompacted cellulose particles 7 may also be present in the granules 5, said particles being indicated by short straight lines and possibly having a coating comprising a surfactant in order to promote the penetration of the liquid, especially the washwater.

Figure 3:
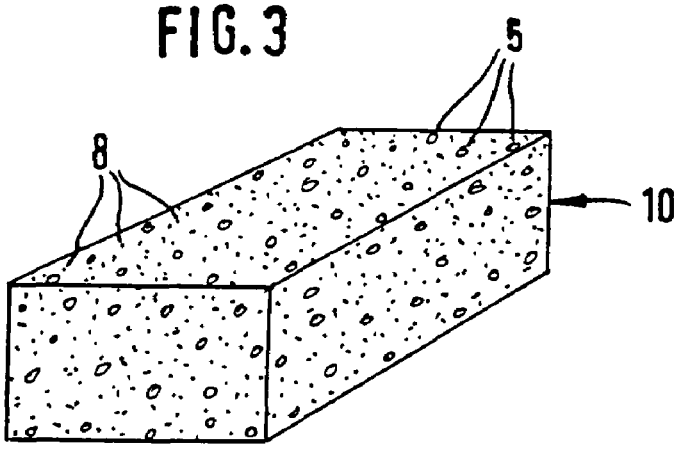
FIG. 3 shows a laundry detergent compact.

The laundry detergent composition is present, in its turn, as a powder/granule mixture. The individual laundry detergent particles are designated as 8 in FIG. 3. The laundry detergent composition is mixed with the granules 5 of TMP, which are depicted as small circles in FIG. 3, and the mixture is then pressed to form a detergent compact 10 which in accordance with FIG. 3 is shaped as a small solid rectangle having edge lengths of from 2 to 3 cm. However, all other forms may be considered; for example, small round disks or the like.

The pressing of the laundry detergent compacts 10 takes place such that they do not crumple in the course of handling and yet when introduced into the liquid they disintegrate almost instantaneously and release the detergent composition. This is brought about by virtue of the granules 5, which in contact with the washwater immediately recover their former shape, i.e., reverse the compacting, and so increase in volume. If the volume increase concerned amounts to 20 percent and the individual particles are, for example, 2 mm in size, contacting with the water produces an expansion of 0.4 mm, which is sufficient to bring about local disintegration of the bonding—induced only by virtue of the dry pressing—of the detergent compact 10, and release of the detergent particles. The granules 5 themselves also disintegrate on contact with the washwater, so that, ultimately, the latter contains only the individual particles 6 and 7 of the cellulose material, which are essentially inert chemically and which also do not cause any other disruption of the washing operation.

What is claimed is:

1. Laundry detergent compact comprising a pulverulent or granular laundry detergent composition and an incorporated disintegrant, said disintegrant consisting of granules of finely divided cellulose material and optionally a coating, wherein the cellulose material is compacted prior to its admixture to the laundry detergent composition and is present in the compact in the form of compacted granules having a density of from 0.5 to 1.5 g/cm$^3$.

2. Laundry detergent compact according to claim 1, wherein the particle size of the cellulose material prior to compaction is from 40 $\mu$m to 60 $\mu$m.

3. Laundry detergent compact according to claim 1, wherein the compacted granules of the cellulose material have a particle size of from 0.2 to 6.0 mm.

4. Laundry detergent compact according to claim 3, wherein the compacted granules of the cellulose material have a particle size of from 0.4 to 1.5 mm.

5. Laundry detergent compact according to claim 2, wherein the weight fraction of the compacted cellulose material in the finished compact is from 3 to 6 percent.

6. Laundry detergent compact according to claim 1, wherein a swelling agent and/or thickener coating is present in the disintegrant.

7. Laundry detergent compact according to claim 1, wherein a surfactant coating is present in the disintegrant.

8. Laundry detergent compact according to claim 7, wherein the surfactant coating is present in a weight fraction of from 0.5 to 2.0 percent of the finished compact.

9. Laundry detergent compact according to claim 1 wherein the compact has been pressed from a mixture of the pulverulent or granular laundry detergent composition with the disintegrant in dry or earth-moist form.

10. Laundry detergent compact according to claim 1, wherein the cellulose material is TMP (thermo-mechanical pulp).

11. Laundry detergent compact according to claim 1, wherein the cellulose material is CTMP (chemo-thermo-mechanical pulp).

12. Laundry detergent compact according to claim 1, wherein the largest dimension of the compact is from 1 to 10 cm.

13. A compacted detergent tablet, comprising a laundry detergent composition and a disintegrant consisting of granules of compacted, finely-divided cellulose material and optionally a coating, said granules having a particle size of from 200 $\mu$m to 6000 $\mu$m.

14. A tablet according to claim 13, wherein the granules of the cellulose material have a particle size of from 300 $\mu$m to 1500 $\mu$m.

15. A tablet according to claim 13, wherein the cellulose material comprises is thermo-mechanical wood pulp.

16. A tablet according to claim 13, wherein the cellulose material is chemo-thermo-mechanical wood pulp.

17. A tablet according to claim 13, wherein the cellulose material is present in an amount of from 3 to 6 wt % of the tablet.

18. A tablet according to claim 13, wherein a surfactant coating is present in the disintegrant.

19. A tablet according to claim 18, wherein the surfactant coating is present in an amount of from 0.5 to 5 wt % of the tablet.

20. A tablet according to claim 13, wherein the finely-divided cellulose material have cellulose particles having a particle size of 20 $\mu$m to 200 $\mu$m before compaction.

21. A tablet according to claim 13, wherein the finely-divided cellulose material have cellulose particles having a particle size of from 40 $\mu$m to 60 $\mu$m before compaction.

22. A process for making a tablet as claimed in claim 13 which comprises pressing a mixture of the detergent composition with the cellulose granules in a dry condition.

23. A process for making a tablet as claimed in claim 13 which comprises pressing a mixture of the detergent composition with the cellulose granules in a moist condition.

* * * * *